US012146661B2

(12) United States Patent
Oh et al.

(10) Patent No.: US 12,146,661 B2
(45) Date of Patent: Nov. 19, 2024

(54) COMBUSTOR NOZZLE, COMBUSTOR, AND GAS TURBINE INCLUDING THE SAME

(71) Applicant: DOOSAN ENERBILITY CO., LTD, Changwon-si (KR)

(72) Inventors: Kyoung Taek Oh, Hwaseong-si (KR); Young Gun Go, Yongin-si (KR); Sang Pil Jo, Seo-gu (KR)

(73) Assignee: Doosan Enerbility Co., Ltd., Changwon-si (KR)

( * ) Notice: Subject to any disclaimer, the term of this patent is extended or adjusted under 35 U.S.C. 154(b) by 0 days.

(21) Appl. No.: 18/123,787

(22) Filed: Mar. 20, 2023

(65) Prior Publication Data

US 2023/0296252 A1 Sep. 21, 2023

(30) Foreign Application Priority Data

Mar. 21, 2022 (KR) ..... 10-2022-0034845

(51) Int. Cl.
*F23D 14/64* (2006.01)
*F23R 3/12* (2006.01)
*F23R 3/28* (2006.01)

(52) U.S. Cl.
CPC ..... *F23R 3/286* (2013.01); *F23D 14/64* (2013.01); *F23R 3/12* (2013.01); *F23R 3/283* (2013.01)

(58) Field of Classification Search
CPC ..... F23D 14/62
See application file for complete search history.

(56) References Cited

U.S. PATENT DOCUMENTS 5,408,830 A * 4/1995 Lovett ..... F23R 3/286 60/737
5,596,873 A * 1/1997 Joshi ..... F23R 3/50 60/738
8,794,545 B2 8/2014 Johnson et al.
9,121,612 B2 9/2015 Uhm et al.
9,134,030 B2 * 9/2015 Bathina ..... F23R 3/045
9,518,742 B2 12/2016 York et al.
10,087,844 B2 10/2018 Hughes et al.
10,215,413 B2 2/2019 Purcell et al.
10,408,455 B2 * 9/2019 Hughes ..... F23R 3/28
(Continued)

FOREIGN PATENT DOCUMENTS

CN 113091094 B * 5/2023 ..... F23R 3/286
DE 19512645 A1 * 10/1996 ..... F23D 11/40
(Continued)

*Primary Examiner* — Alain Chau
*Assistant Examiner* — Marc Amar
(74) *Attorney, Agent, or Firm* — Shook, Hardy & Bacon L.L.P.

(57) ABSTRACT

Disclosed herein is a nozzle for a combustor that burns fuel containing hydrogen, which includes a plurality of mixing tubes through which air and fuel flow, and a multi-tube configured to insert the mixing tubes thereinto and support the same, wherein each of the mixing tubes has an inlet formed at a longitudinal end thereof for introduction of a first fluid, and a plurality of supply ports formed on a circumferential surface thereof for introduction of a second fluid, the mixing tube has a plurality of first supply ports formed on a first surface thereof, and a plurality of second supply ports formed on a second surface facing the first surface, and the first supply ports are staggered with the second supply ports.

15 Claims, 8 Drawing Sheets

(56) References Cited

U.S. PATENT DOCUMENTS

| | | | | |
|---|---|---|---|---|
| 11,079,112 | B2 | 8/2021 | Seo | |
| 11,079,113 | B2 | 8/2021 | Tada et al. | |
| 11,846,417 | B2 * | 12/2023 | Go | F23D 14/58 |
| 11,846,424 | B2 * | 12/2023 | Go | F23R 3/286 |
| 11,988,380 | B2 * | 5/2024 | Go | F23D 14/70 |
| 2004/0244379 | A1 * | 12/2004 | Walker | F01D 9/04 60/751 |
| 2009/0158743 | A1 * | 6/2009 | Francis | F23R 3/286 60/748 |
| 2009/0293484 | A1 * | 12/2009 | Inoue | F23R 3/286 60/740 |
| 2010/0008179 | A1 * | 1/2010 | Lacy | F23R 3/34 366/134 |
| 2010/0031662 | A1 | 2/2010 | Zuo | |
| 2011/0197587 | A1 * | 8/2011 | Zuo | F23D 14/02 239/398 |
| 2012/0180487 | A1 | 7/2012 | Uhm et al. | |
| 2012/0317973 | A1 * | 12/2012 | Gulen | F01K 23/065 60/39.182 |
| 2013/0104556 | A1 | 5/2013 | Uhm et al. | |
| 2013/0167538 | A1 * | 7/2013 | Laster | F23R 3/286 60/734 |
| 2013/0219899 | A1 * | 8/2013 | Uhm | F23C 7/004 60/738 |
| 2013/0232979 | A1 * | 9/2013 | Singh | F23R 3/286 60/737 |
| 2013/0269351 | A1 | 10/2013 | Hu et al. | |
| 2013/0283810 | A1 | 10/2013 | Idahosa et al. | |
| 2014/0083100 | A1 * | 3/2014 | Cunha | F23R 3/286 60/737 |
| 2015/0135718 | A1 | 5/2015 | Hughes et al. | |
| 2015/0153045 | A1 * | 6/2015 | York | F23R 3/286 60/738 |
| 2016/0033133 | A1 | 2/2016 | Johnson et al. | |
| 2016/0186662 | A1 * | 6/2016 | Stewart | F23R 3/14 239/403 |
| 2017/0138267 | A1 * | 5/2017 | Hughes | F23D 14/64 |
| 2018/0051883 | A1 * | 2/2018 | Meadows | F23R 3/286 |
| 2019/0107284 | A1 * | 4/2019 | Seo | F23R 3/286 |
| 2022/0243917 | A1 * | 8/2022 | Go | F01D 9/023 |

FOREIGN PATENT DOCUMENTS

| | | | |
|---|---|---|---|
| JP | 1996-082419 | A | 3/1996 |
| JP | 2012-149868 | A | 8/2012 |
| JP | 2013-181746 | A | 9/2013 |
| JP | 2013-190201 | A | 9/2013 |
| JP | 2013-231583 | A | 11/2013 |
| JP | 5538113 | B2 | 7/2014 |
| JP | 2015-105821 | A | 6/2015 |
| JP | 2017-096618 | A | 6/2017 |
| JP | 2017-166809 | A | 9/2017 |
| KR | 10-0193294 | B1 | 6/1999 |
| KR | 10-1110144 | B1 | 2/2012 |
| KR | 10-2019-0040666 | A | 4/2019 |
| KR | 10-2019-0128232 | A | 11/2019 |
| KR | 10-2020-0070362 | A | 6/2020 |
| KR | 10-2164622 | B1 | 10/2020 |

* cited by examiner

COMBUSTOR NOZZLE, COMBUSTOR, AND GAS TURBINE INCLUDING THE SAME

CROSS-REFERENCE TO RELATED APPLICATION

This application claims priority to Korean Patent Application No. 10-2022-0034845, filed on Mar. 21, 2022 the disclosure of which is incorporated herein by reference in its entirety.

BACKGROUND

Technical Field

Exemplary embodiments relate to a combustor nozzle, and a combustor and gas turbine including the same. The combustor may use at least one of hydrogen fuel and natural gas fuel.

Related Art

The gas turbine is a power engine that mixes air compressed by a compressor with fuel for combustion and rotates a turbine with hot gas produced by the combustion. The gas turbine is used to drive a generator, an aircraft, a ship, a train, etc.

The gas turbine typically includes a compressor, a combustor, and a turbine. The compressor sucks and compresses outside air, and then transmits the compressed air to the combustor. The air compressed by the compressor becomes high pressure and high temperature. The combustor mixes the compressed air flowing thereinto from the compressor with fuel and burns a mixture thereof. The combustion gas produced by the combustion is discharged to the turbine. Turbine blades in the turbine are rotated by the combustion gas, thereby generating power. The generated power is used in various fields, such as generating electric power and actuating machines.

Fuel is injected through nozzles installed in each combustor section of the combustor, and the nozzles allow for injection of gas fuel and/or liquid fuel. In recent years, it is recommended to use hydrogen fuel or fuel containing hydrogen to inhibit the emission of carbon dioxide.

However, since hydrogen has a high combustion rate, when hydrogen fuel or fuel containing hydrogen is burned in a gas turbine combustor, the flame formed in the gas turbine combustor approaches and heats the structure of the gas turbine combustor, which may cause a problem with the reliability of the gas turbine combustor.

In order to solve this problem, Korean Patent Application Publication No. 10-2020-0027894 discloses a combustor nozzle with a multi-tube. However, in the nozzle with the multi-tube, it may be difficult to uniformly mix fuel and air since no swirler is installed in the nozzle.

SUMMARY

Aspects of one or more exemplary embodiments provide a combustor nozzle that enables uniform mixing of fuel and air, a combustor, and a gas turbine including the same.

Additional aspects will be set forth in part in the description which follows and, in part, will become apparent from the description, or may be learned by practice of the exemplary embodiments.

According to an aspect of an exemplary embodiment, there is provided a nozzle for a combustor that burns fuel containing hydrogen, which includes a plurality of mixing tubes through which air and fuel flow, and a multi-tube configured to insert the mixing tubes thereinto and support the same, wherein each of the mixing tubes has an inlet formed at a longitudinal end thereof for introduction of a first fluid, and a plurality of supply ports formed on a circumferential surface thereof for introduction of a second fluid, the mixing tube has a plurality of first supply ports formed on a first surface thereof, and a plurality of second supply ports formed on a second surface facing the first surface, and the first supply ports are staggered with the second supply ports.

The first supply ports may be staggered with the second supply ports in a width direction of the mixing tube.

The first supply ports may be staggered with the second supply ports in a longitudinal direction of the mixing tube.

The individual first supply ports may each be positioned between the corresponding second supply ports, and the second fluid may be injected from the first supply ports and the second supply ports in opposite directions to form a vortex.

The mixing tube may have a rectangular cross-section in which its width is greater than its height.

The mixing tube may include two curved surfaces that connect the first surface and the second surface and each have an arc shape.

The mixing tube may include an inlet passage having the inlet formed at one end thereof and the supply ports formed on an inner wall thereof, an inclined passage connected to the inlet passage and inclined with respect to the inlet passage, and an outlet passage connected to the inclined passage to inject a mixed fluid into a combustion chamber.

The outlet passage may have a larger cross-sectional area than the inlet passage.

The inclined passage may have a variable cross-sectional area that gradually increases from the inlet passage to the outlet passage.

The mixing tube may include a plurality of inlet passages, a plurality of inclined passages connected to the respective inlet passages, and one outlet passage connected to the inclined passages to inject the mixed fluid into the combustion chamber.

The inclined passages may be inclined in the same direction with respect to the outlet passage.

The inclined passages may be inclined in opposite directions with respect to the outlet passage.

A most-downstream supply port of the plurality of inlet passages in the longitudinal direction thereof may be formed on a surface positioned outwardly from the center of the mixing tube.

A most-downstream supply port of the plurality of inlet passages in the longitudinal direction thereof may be formed on a surface positioned inwardly from the center of the mixing tube.

According to an aspect of another exemplary embodiment, there is provided a combustor including a burner having a plurality of nozzles for injecting fuel and air, and a duct assembly coupled to one side of the burner to burn a mixture of the fuel and the air therein and transmit combustion gas to a turbine. Each of the nozzles includes a plurality of mixing tubes through which air and fuel flow, and a multi-tube configured to insert the mixing tubes thereinto and support the same. Each of the mixing tubes has an inlet formed at a longitudinal end thereof for introduction of a first fluid, and a plurality of supply ports formed on a circumferential surface thereof for introduction of a second fluid. The mixing tube has a plurality of first supply ports formed on a first surface thereof, and a plurality of second supply ports formed on a second surface facing the first surface. The first supply ports are staggered with the second supply ports.

The first supply ports may be staggered with the second supply ports in a width direction of the mixing tube.

The first supply ports may be staggered with the second supply ports in a longitudinal direction of the mixing tube.

The individual first supply ports may each be positioned between the corresponding second supply ports, and the second fluid may be injected from the first supply ports and the second supply ports in opposite directions to form a vortex.

The mixing tube may include an inlet passage having the inlet formed at one end thereof and the supply ports formed on an inner wall thereof, an inclined passage connected to the inlet passage and inclined with respect to the inlet passage, and an outlet passage connected to the inclined passage to inject a mixed fluid into a combustion chamber.

According to an aspect of a further exemplary embodiment, there is provided a gas turbine including a compressor configured to compress air introduced thereinto from the outside, a combustor configured to mix fuel with the air compressed by the compressor for combustion, and a turbine having a plurality of turbine blades rotated by combustion gas produced by the combustion in the combustor. The combustor includes a burner having a plurality of nozzles for injecting the fuel and the air, and a duct assembly coupled to one side of the burner to burn a mixture of the fuel and the air therein and transmit the combustion gas to the turbine. Each of the nozzles includes a plurality of mixing tubes through which air and fuel flow, and a multi-tube configured to insert the mixing tubes thereinto and support the same. Each of the mixing tubes has an inlet formed at a longitudinal end thereof for introduction of a first fluid, and a plurality of supply ports formed on a circumferential surface thereof for introduction of a second fluid. The mixing tube has a plurality of first supply ports formed on a first surface thereof, and a plurality of second supply ports formed on a second surface facing the first surface. The first supply ports are staggered with the second supply ports.

The first supply ports may be staggered with the second supply ports in a width direction of the mixing tube.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
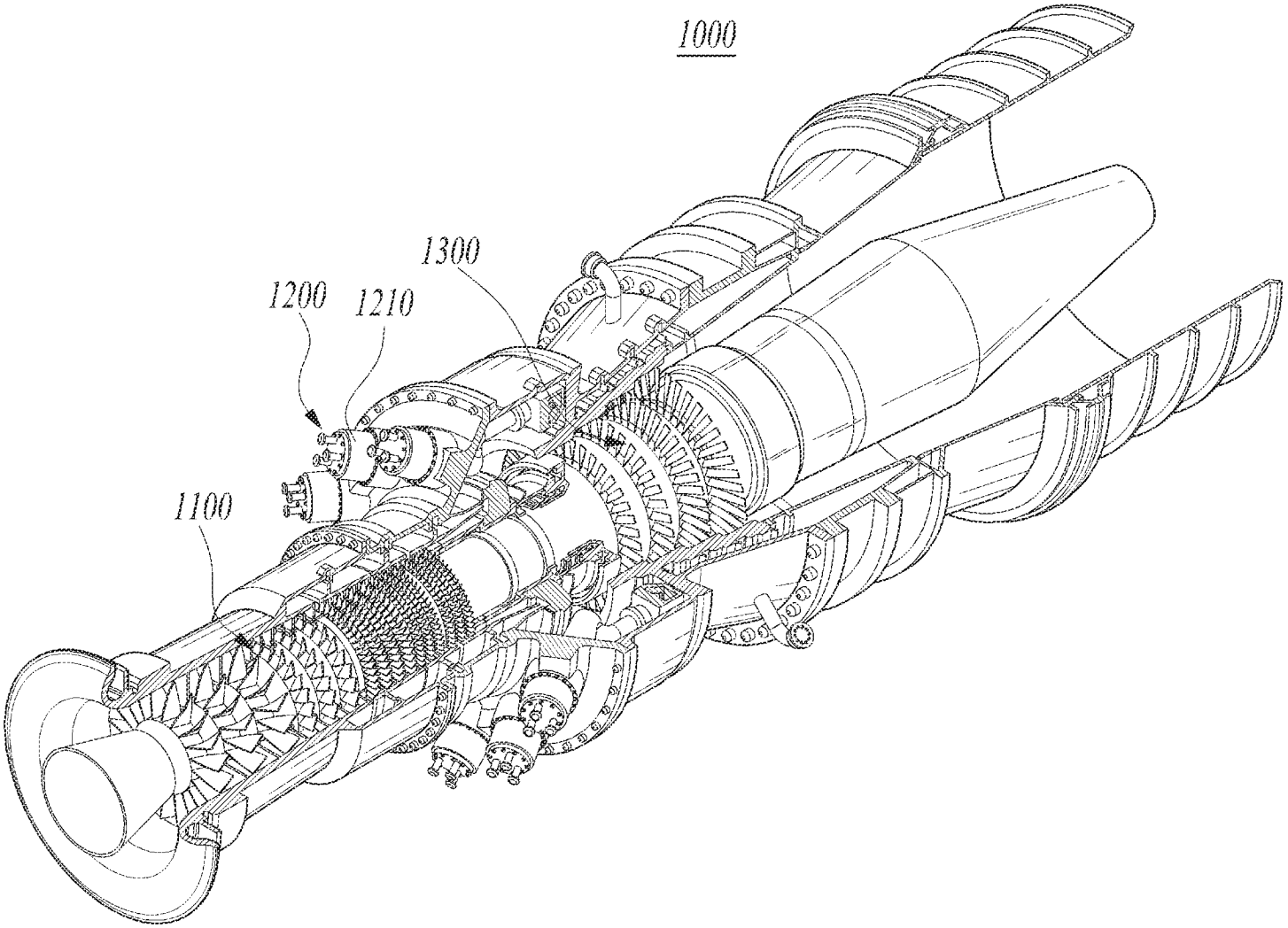
FIG. 1 is a view illustrating an interior of a gas turbine according to a first exemplary embodiment.

Various modifications and different embodiments will be described below in detail with reference to the accompanying drawings so that those skilled in the art can easily carry out the disclosure. It should be understood, however, that the present disclosure is not intended to be limited to the specific embodiments, but the present disclosure includes all modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Hereinafter, a gas turbine according to a first exemplary embodiment will be described.

Figure 2:
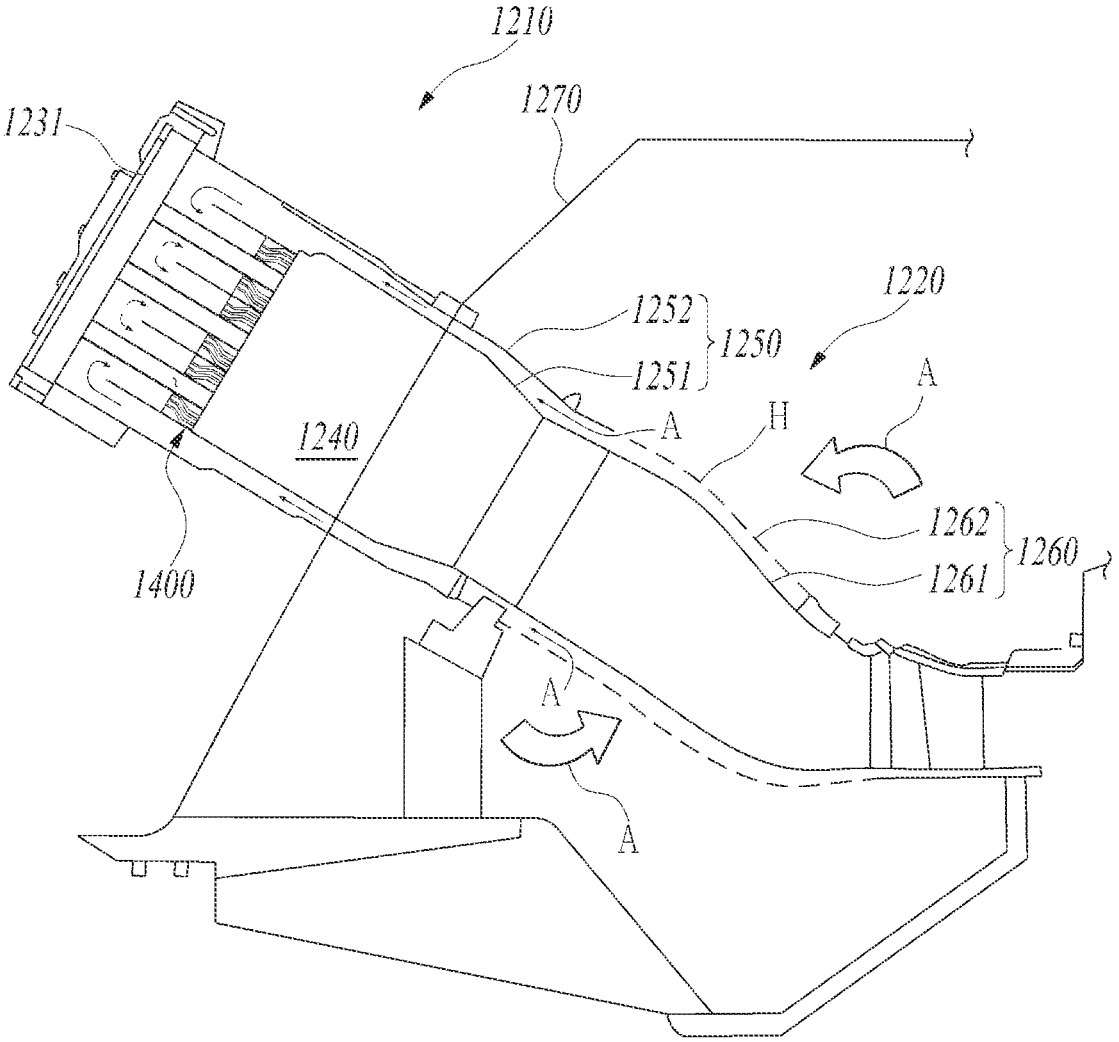
FIG. 2 is a view illustrating the combustor of FIG. 1.

FIG. 1 is a view illustrating the interior of the gas turbine according to the first exemplary embodiment. FIG. 2 is a view illustrating a combustor according to the first exemplary embodiment.

Referring to FIGS. 1 and 2, the thermodynamic cycle of the gas turbine, which is designated by reference numeral 1000, according to the exemplary embodiment may ideally follow a Brayton cycle. The Brayton cycle may consist of four phases including isentropic compression (adiabatic compression), isobaric heat addition, isentropic expansion (adiabatic expansion), and isobaric heat dissipation. In other words, in the Brayton cycle, thermal energy may be released by combustion of fuel in an isobaric environment after the atmospheric air is sucked and compressed to a high pressure, hot combustion gas may be expanded to be converted into kinetic energy, and exhaust gas with residual energy may then be discharged to the atmosphere. The Brayton cycle may consist of four processes, i.e., compression, heating, expansion, and exhaust.

The gas turbine 1000 using the above Brayton cycle may include a compressor 1100, a combustor 1200, and a turbine 1300, as illustrated in FIG. 1. Although the following description is given with reference to FIG. 1, the present disclosure may be widely applied to a turbine engine having the same configuration as the gas turbine 1000 exemplarily illustrated in FIG. 1.

Referring to FIG. 1, the compressor 1100 of the gas turbine 1000 may suck air from the outside and compress the air. The compressor 1100 may supply the combustor 1200 with the air compressed by compressor blades 1130, and may supply cooling air to a hot region required for cooling in the gas turbine 1000. In this case, since the air sucked into the compressor 1100 is subject to an adiabatic compression process therein, the pressure and temperature of the air that has passed through the compressor 1100 increase.

The compressor 1100 is designed as a centrifugal compressor or an axial compressor. In general, the centrifugal compressor is applied to a small gas turbine, whereas the multistage axial compressor is applied to the large gas turbine 1000 as illustrated in FIG. 1 because it is necessary to compress a large amount of air. In the multistage axial compressor, the compressor blades 1130 of the compressor 1100 rotate along with the rotation of rotor disks to compress air introduced thereinto while delivering the compressed air to rear-stage compressor vanes 1140. The air is compressed increasingly to a high pressure while passing through the compressor blades 1130 formed in a multistage manner.

A plurality of compressor vanes 1140 may be formed in a multistage manner and mounted in a compressor casing 1150. The compressor vanes 1140 guide the compressed air, which flows from front-stage compressor blades 1130, to rear-stage compressor blades 1130. In an exemplary embodiment, at least some of the plurality of compressor vanes 1140 may be mounted so as to be rotatable within a fixed range for regulating the inflow rate of air or the like.

The compressor 1100 may be driven by some of the power output from the turbine 1300. To this end, the rotary shaft of the compressor 1100 may be directly connected to the rotary shaft of the turbine 1300, as illustrated in FIG. 1. In the large gas turbine 1000, the compressor 1100 may require almost half of the power generated by the turbine 1300 for driving. Accordingly, the overall efficiency of the gas turbine 1000 can be enhanced by directly increasing the efficiency of the compressor 1100.

The turbine 1300 includes a plurality of rotor disks 1310, a plurality of turbine blades radially arranged on each of the rotor disks 1310, and a plurality of turbine vanes. Each of the rotor disks 1310 has a substantially disk shape and has a plurality of grooves formed on the outer peripheral portion thereof. The grooves are each formed to have a curved surface so that the turbine blades are inserted into the grooves, and the turbine vanes are mounted in a turbine casing. The turbine vanes are fixed so as not to rotate and serve to guide the direction of flow of the combustion gas that has passed through the turbine blades. The turbine blades generate rotational force while rotating by the combustion gas.

Meanwhile, the combustor 1200 may mix the compressed air, which is supplied from the outlet of the compressor 1100, with fuel for isobaric combustion to produce combustion gas with high energy.

The combustor 1200 mixes the compressed air, which is supplied from the outlet of the compressor 1100, with fuel for isobaric combustion to produce combustion gas with high energy. The combustor 1200 is disposed downstream of the compressor 1100 and includes a plurality of burners 1210 arranged annularly around its axis of rotation.

As illustrated in FIG. 2, each of the burners 1210 may include a duct assembly 1220 having a combustion chamber 1240 in which fuel fluid is burned, and a plurality of nozzles 1400 having multi-tubes 1410 for injecting the fuel fluid into the combustion chamber 1240. The fuel fluid may be supplied from a fuel tank in which fuel (e.g., hydrogen) is stored.

The gas turbine may use gas fuel containing hydrogen and/or natural gas, liquid fuel, or composite fuel as a combination thereof, which is the fuel fluid in the present exemplary embodiment. For the gas turbine, it is important to make a combustion environment for reducing an amount of emission such as carbon monoxide or nitrogen oxide that is subject to legal regulations. Accordingly, premixed combustion has been increasingly used in recent years in that it enables uniform combustion to reduce emission by lowering a combustion temperature even though it is relatively difficult to control the premixed combustion.

In the case of premixed combustion, after the compressed air introduced from the compressor 1100 is mixed with fuel in the nozzle 1400, the mixture thereof enters the combustion chamber 1240. When combustion is stable after premixed gas is initially ignited by an igniter, the combustion is maintained by the supply of fuel and air.

The duct assembly 1220 includes the combustion chamber 1240, which is a space for combustion, and further includes a liner 1250 and a transition piece 1260.

The liner 1250 may be disposed downstream of the nozzle 1400 and may have a double structure of an inner liner 1251 and an outer liner 1252. That is, the liner 1250 may have a double structure in which the inner liner 1251 is surrounded by the outer liner 1252. In this case, the inner liner 1251 is a hollow tubular member, and the inside of the inner liner 1251 defines the combustion chamber 1240. The inner liner 1251 may be cooled by the compressed air penetrating into an annular space inside the outer liner 1252 through a compressed air inlet hole H.

The transition piece 1260 may be positioned downstream of the liner 1250, which allows combustion gas produced in the combustion chamber 1240 to be released at high speed to the turbine 1300. The transition piece 1260 may have a double structure of an inner transition piece 1261 and an outer transition piece 1262. That is, the transition piece 1260 may have a double structure in which the inner transition piece 1261 is surrounded by the outer transition piece 1262. Like the inner liner 1251, the inner transition piece 1261 may also be a hollow tubular member. The inner transition piece 1261 may have a diameter that gradually decreases from the liner 1250 toward the turbine 1300. In this case, the inner liner 1251 and the inner transition piece 1261 may be coupled to each other by a plate spring seal (not shown). The respective ends of the inner liner 1251 and the inner transition piece 1261 are fixed to the combustor 1200 and the turbine 1300, and the plate spring seal has a structure that accommodates an extension in length and diameter due to thermal expansion. As a result, the inner liner 1251 and the inner transition piece 1261 may be supported.

The outer liner 1252 and the outer transition piece 1262 may surround the inner liner 1251 and the inner transition piece 1261, respectively. Compressed air may penetrate into an annular space between the inner liner 1251 and the outer liner 1252 and an annular space between the inner transition piece 1261 and the outer transition piece 1262 through the compressed air inlet hole H. The inner liner 1251 and the inner transition piece 1261 may be cooled by the compressed air penetrating into the annular spaces.

Meanwhile, the high-temperature and high-pressure combustion gas produced in the combustor 1200 is supplied to the turbine 1300 through the liner 1250 and the transition piece 1260. In the turbine 1300, the combustion gas applies impingement or reaction force to the turbine blades radially disposed on the rotary shaft of the turbine 1300 while expanding adiabatically, so that the thermal energy of the combustion gas is converted into mechanical energy for rotating the rotary shaft. Some of the mechanical energy obtained from the turbine 1300 is supplied as energy required to compress air in the compressor, and the rest is utilized as effective energy, such as for driving the power generator to generate electric power.

Referring back to FIG. 2, the compressed air A flowing into the burner 1210 is accommodated by a combustor casing 1270 and an end cover 1231 coupled to each other. The compressed air A may flow into the annular space inside the liner 1250 or the transition piece 1260 through the compressed air inlet hole H, and then be introduced into the multi-tubes 1410 through switching of the direction of flow thereof by the end cover 1231.

Figure 3:
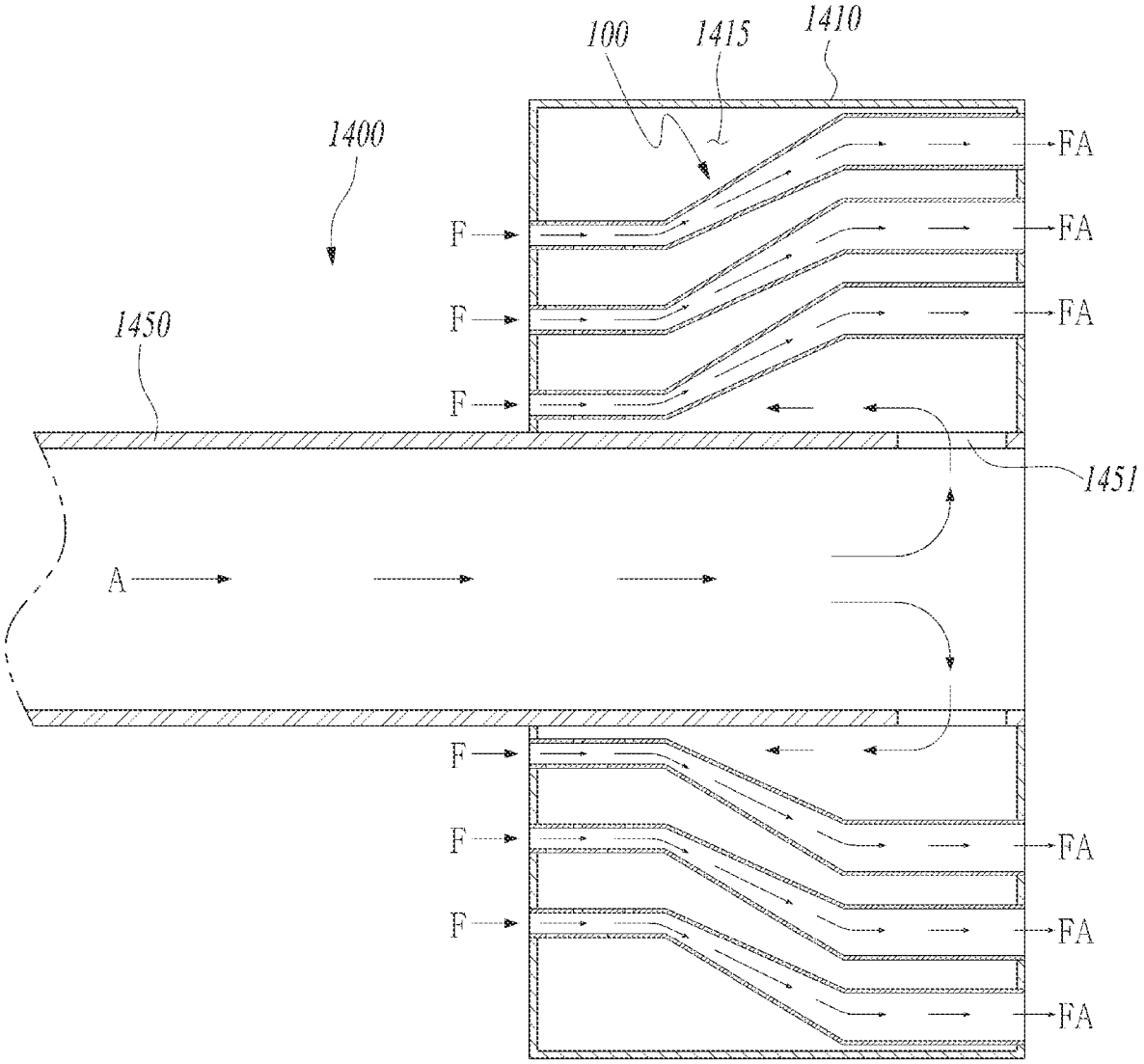
FIG. 3 is a longitudinal cross-sectional view illustrating one nozzle according to the first exemplary embodiment.
Figure 4:
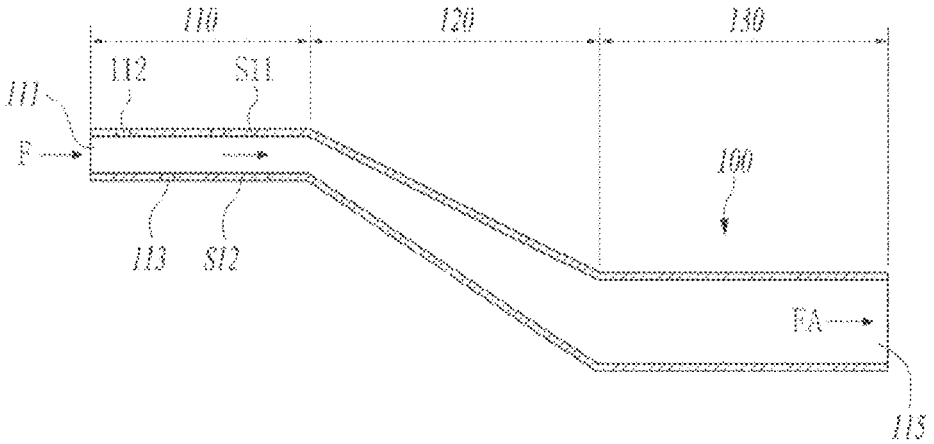
FIG. 4 is a longitudinal cross-sectional view illustrating one mixing tube according to the first exemplary embodiment.
Figure 5:
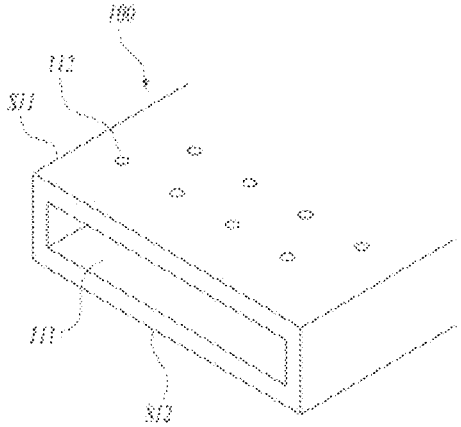
FIG. 5 is a perspective view illustrating an inlet passage according to the first exemplary embodiment.
Figure 6:
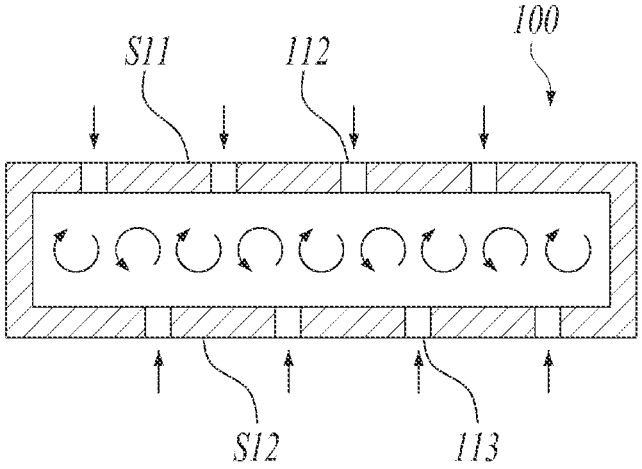
FIG. 6 is a transverse cross-sectional view illustrating the inlet passage according to the first exemplary embodiment.

FIG. 3 is a longitudinal cross-sectional view illustrating one nozzle according to the first exemplary embodiment. FIG. 4 is a longitudinal cross-sectional view illustrating one mixing tube according to the first exemplary embodiment. FIG. 5 is a perspective view illustrating an inlet passage according to the first exemplary embodiment. FIG. 6 is a transverse cross-sectional view illustrating the inlet passage according to the first exemplary embodiment.

Referring to FIGS. 3 to 6, each nozzle 1400 may include a multi-tube 1410 that includes a plurality of mixing tubes 100 through which air and fuel flow and a passage 1415 through which air flows.

The multi-tube 1410 is cylindrical and has the passage 1415 defined therein for supply of air. The nozzle 1400 may further include an air supply pipe 1450 for supplying air to the multi-tube 1410.

The air supply pipe 1450 extends into the multi-tube, and air A is dispersed to the passage 1415 in the multi-tube 1410 through supply holes 1451 formed in the air supply pipe 1450. The air A dispersed into the multi-tube 1410 may be introduced into the mixing tubes 100 through supply ports 112 and 113.

The plurality of mixing tubes 100 are installed inside the multi-tube 1410 to form several small flames using hydrogen gas. The mixing tubes 100 may be spaced apart from each other in the multi-tube 1410.

Each of the mixing tubes 100 has a tubular shape and includes an inlet 111 through which fuel is introduced and an outlet 115 through which fuel and air are injected. A supply pipe for supply of fuel F may be connected to the rear end of the mixing tube 100. Here, the fuel F may be gas containing hydrogen. The mixing tube 100 may allow for mixing and fine injection of hydrogen and air.

Although the present exemplary embodiment illustrates that fuel is introduced through the inlet 111 of the mixing tube 100 and air is introduced into the multi-tube 1410, the present disclosure is not limited thereto. For example, air may be introduced through the inlet 111 and fuel may be introduced into the multi-tube 1410.

The mixing tube 100 may include a first surface S11 and a second surface S12 arranged parallel to each other, and may have a rectangular parallelepiped shape. However, the present disclosure is not limited thereto. For example, the mixing tube 100 may have a polygonal cross-sectional shape.

The mixing tube 100 includes an inlet passage 110, an inclined passage 120, and an outlet passage 130. The inlet 111 is formed at the longitudinal end of the inlet passage 110 for introduction of fuel, and the supply ports 112 are formed on the inner wall of the inlet passage 110 for supply of air. The air A supplied through the supply ports 112 is introduced in a direction crossing the direction in which the fuel introduced through the inlet 111 flows. The fuel F and the air A are mixed in the inlet passage 110 flow to the inclined passage 120 while forming a mixed fluid F.

The inclined passage 120 is connected to the inlet passage 110 and is inclined with respect to the inlet passage 110. The inclined passage 120 is formed to gradually increase in height toward the outlet passage 130, and has a variable cross-sectional area in which its height gradually increases in the longitudinal direction thereof.

The outlet passage 130 is spaced apart from the inlet passage 110 in the radial direction of the multi-tube 1410, and allows air mixed with fuel to be discharged to the combustion chamber 1240. As a result, the inlet passage 110 may have the smallest cross-sectional area and the outlet passage 130 may have the largest cross-sectional area.

According to the nozzle 1400 of the exemplary embodiment configured as described above, since the radiant heat transferred into the mixing tube 100 through the outlet passage 130 among the radiant heats by the flames generated in the combustion chamber 1240 is repeatedly reflected on the gradually narrowing inner wall of the inclined passage 120, it does not reach the inlet passage 110 in which the fuel F and the air A are mixed, but is discharged back to the combustion chamber 1240 through the outlet passage 130. Therefore, it is possible to prevent spontaneous ignition and flashback phenomena caused by the transfer of that radiant heat to the region where the fuel F and the air A are mixed.

The plurality of supply ports 112 and 113 are formed on the circumferential surface of the mixing tube 100 and are spaced apart in the longitudinal and width directions of the mixing tube 100.

The plurality of first supply ports 112 formed on the first surface S11 of the mixing tube 100 may be staggered with the plurality of second supply ports 113 formed on the second surface S12 facing the first surface S11. Here, the first surface S11 and the second surface S12 may be planar and in parallel, but the present disclosure is not limited thereto.

When the first supply ports 112 are staggered with the second supply ports 113, the individual second supply ports 113 may each be positioned between the corresponding first supply ports 112 and the individual first supply ports 112 may each be positioned between the corresponding second supply ports 113.

The first supply ports 112 may be staggered with the second supply ports 113 in the width direction of the mixing tube 100. Moreover, the first supply ports 112 may be staggered with the second supply ports 113 in the longitudinal direction of the mixing tube 100 as well. That is, the second surface S12 corresponding to the first supply ports 112 may be blocked, and the first surface S11 corresponding to the second supply ports 113 may be blocked.

Air is injected through the supply ports 112 and 113 in a direction perpendicular to the direction of flow of fuel. In this case, a vortex may be formed by the air injected through the first and second supply ports 112 and 113 staggered with each other, which allows fuel and air to be more easily mixed.

Figure 7:
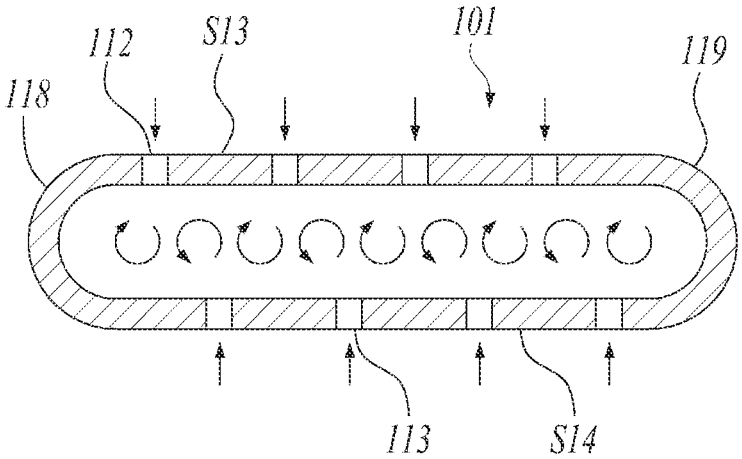
FIG. 7 is a transverse cross-sectional view illustrating an inlet passage according to a second exemplary embodiment.

Referring to FIG. 7, each mixing tube 101 according to a second exemplary embodiment may include a first surface S13 and a second surface S14 that face each other and are disposed in parallel, and two curved surfaces 118 and 119 that connect the first surface S13 and the second surface S13. The curved surfaces 118 and 119 may each be curved in an arc shape to connect the widthwise ends of the first and second surfaces S13 and S14.

A plurality of supply ports 112 and 113 may be formed on the respective first and second surfaces S13 and S14 and staggered with each other in the width and longitudinal directions of the mixing tube 101. Although a vortex is formed in the mixing tube 101 by the supply ports 112 and 113 staggered with each other, air and fuel may not be mixed uniformly due to a relatively low flow rate at the corner of the mixing tube 101. However, the formation of the two curved surfaces 118 and 119 as in the present exemplary embodiment can increase the flow rate at the side end of the mixing tube 101, thereby allowing fuel and air to be mixed uniformly.

Hereinafter, a gas turbine according to a third exemplary embodiment will be described.

Figure 8:
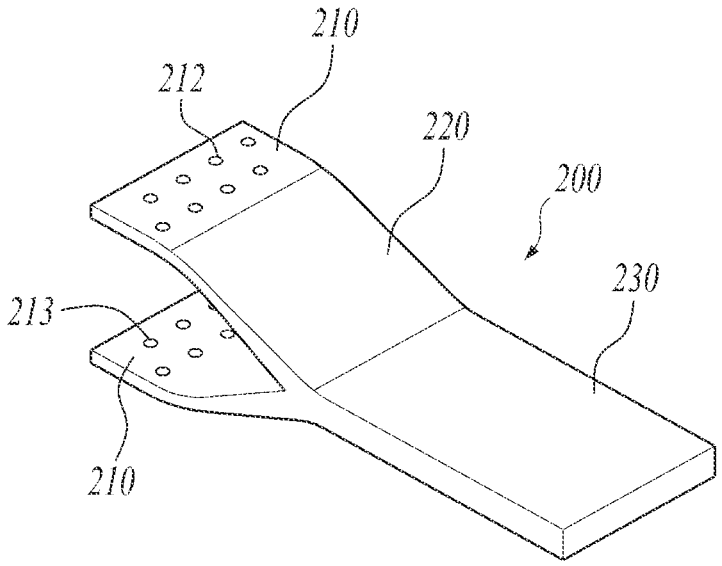
FIG. 8 is a perspective view illustrating one mixing tube according to a third exemplary embodiment.
Figure 9:
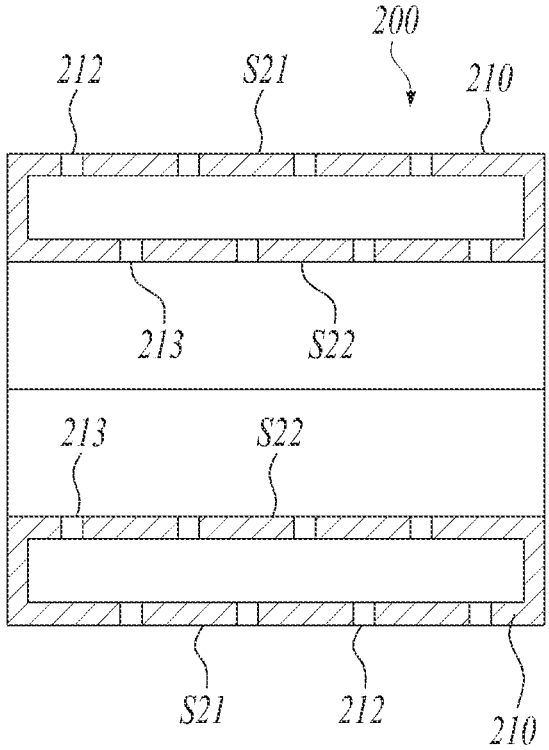
FIG. 9 is a transverse cross-sectional view illustrating the mixing tube according to the third exemplary embodiment.
Figure 10:
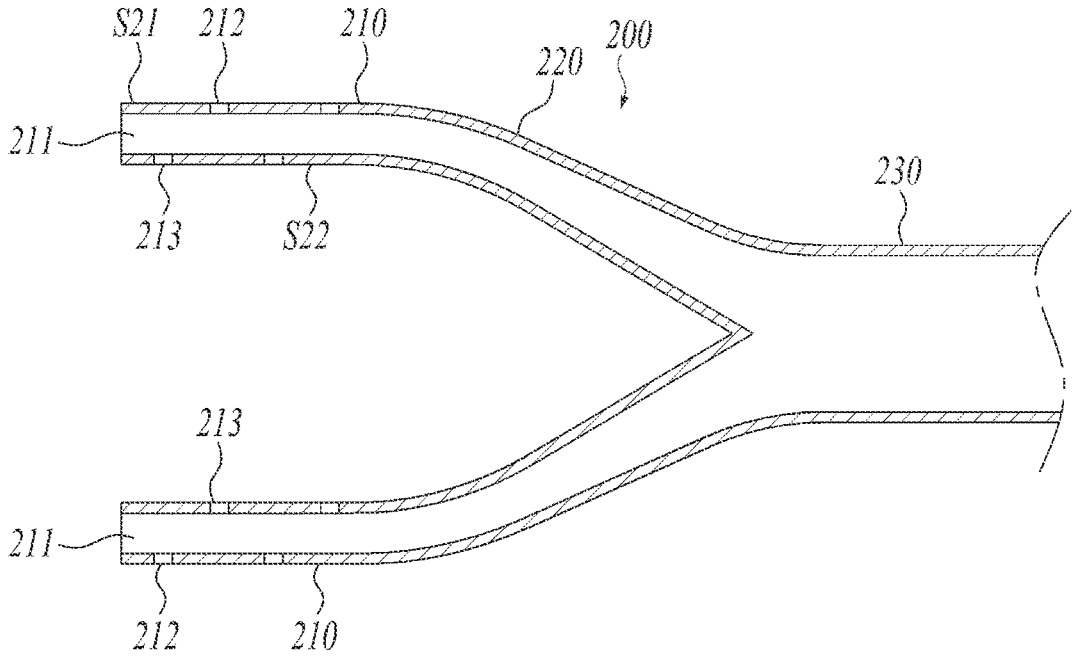
FIG. 10 is a longitudinal cross-sectional view illustrating the mixing tube according to the third exemplary embodiment.

FIG. 8 is a perspective view illustrating one mixing tube according to the third exemplary embodiment. FIG. 9 is a transverse cross-sectional view illustrating the mixing tube according to the third exemplary embodiment. FIG. 10 is a longitudinal cross-sectional view illustrating the mixing tube according to the third exemplary embodiment.

Referring to FIGS. 8 and 10, since the gas turbine according to the present exemplary embodiment has the same structure as the gas turbine according to the first exemplary embodiment, with the sole exception of mixing tubes 200, a redundant description thereof will be omitted.

Each mixing tube 200 includes two inlet passages 210, two inclined passages 220, and one outlet passage 230. Each of the inlet passages 210 has an inlet 211 formed at the end thereof for introduction of fuel, and supply ports 213 formed on the inner wall thereof for supply of air. The fuel introduced through the inlet 211 and the air supplied through the supply ports 212 and 213 are mixed in the inlet passage 210 flow to an associated one of the inclined passages 220 while forming a mixed fluid FA. The two inlet passages may be spaced apart from each other.

Each of the inclined passages 220 is connected to an associated one of the inlet passages 210 and is inclined with respect to that inlet passage 210. The inclined passage 220 is formed to gradually increase in inner diameter toward the outlet passage 230, and thus has a variable cross-sectional area in which its inner diameter gradually increases in the longitudinal direction thereof. The two inclined passages 220 may be connected to the inlet passages 210, respectively. The inclined passages 220 may be inclined in opposite directions to have a distance therebetween that gradually decreases in a downstream direction.

The outlet passage 230 is spaced apart from the inlet passages 210 in the radial direction of the multi-tube, and allows air mixed with fuel to be discharged to the combustion chamber. The two inclined passages 220 may be connected to the outlet passage 230, and the premixed fuel introduced from the inclined passages 220 may join at the outlet passage 230.

The plurality of supply ports 212 and 213 are formed on the mixing tube 200 and are spaced apart in the longitudinal and width directions of the mixing tube 200. The plurality of first supply ports 212 formed on the first surface S21 of the mixing tube 200 may be staggered with the plurality of second supply ports 213 formed on the second surface S22 facing the first surface S21.

Here, the first surface S21 may be a surface positioned outwardly from the center of the mixing tube 200, and the second surface may be a surface positioned inwardly from the center of the mixing tube 200. The most-downstream supply ports 212 of the two inlet passages 210 in the longitudinal direction thereof may be formed on a corresponding first outer surface S21.

When the most-downstream supply ports 212 are formed on that first outer surface S21, the concentration of fuel is high in the center of the outlet passage 230 and is relatively low on the outside of the outlet passage 230. If the concentration of fuel needs to be high in the center of the mixing tube 200 according to the operating condition of the gas turbine, this mixing tube 200 may be applied to control the concentration of fuel.

Hereinafter, a gas turbine according to a fourth exemplary embodiment will be described.

Figure 11:
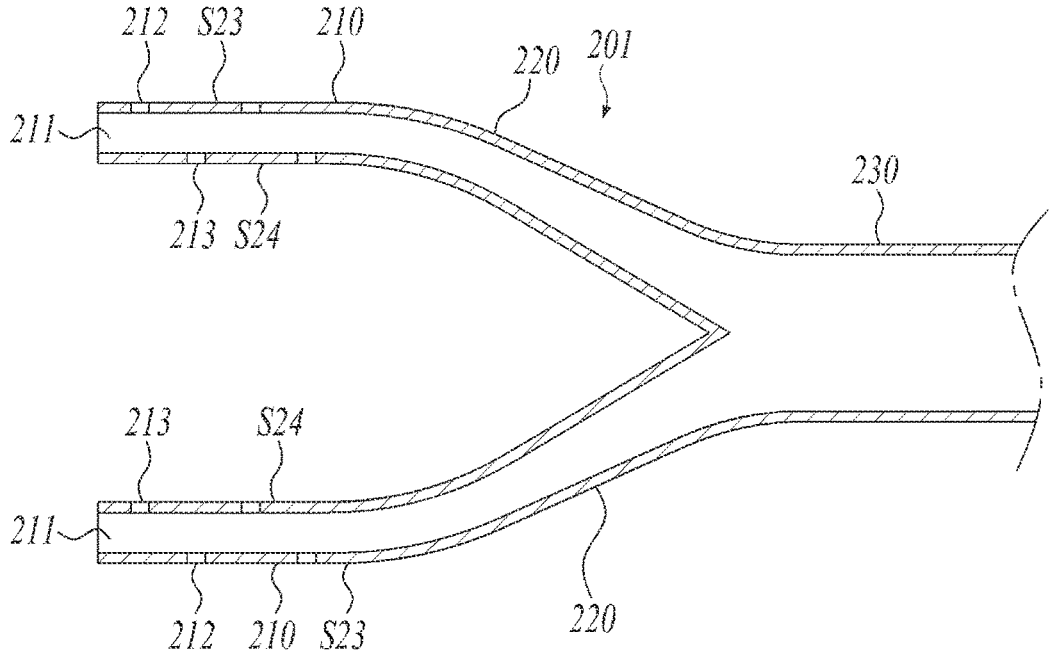
FIG. 11 is a longitudinal cross-sectional view illustrating one mixing tube according to a fourth exemplary embodiment.

FIG. 11 is a longitudinal cross-sectional view illustrating one mixing tube according to the fourth exemplary embodiment.

Referring to FIG. 11, since the gas turbine according to the present exemplary embodiment has the same structure as the gas turbine according to the third exemplary embodiment, with the sole exception of supply ports 212 and 213, a redundant description thereof will be omitted.

Each mixing tube 201 includes two inlet passages 210, two inclined passages 220, and one outlet passage 230. The two inlet passages 210 are spaced apart from each other. The two inclined passages 220 are connected to the inlet passages 210, respectively, and are inclined in opposite directions. The two inclined passages 220 may be connected to the outlet passage 230, and the premixed fuel introduced from the inclined passages 220 may join at the outlet passage 230.

The plurality of supply ports 212 and 213 are formed on the mixing tube 201 and are spaced apart in the longitudinal and width directions of the mixing tube 201. The plurality of first supply ports 212 formed on the first surface S23 of the mixing tube 201 may be staggered with the plurality of second supply ports 213 formed on the second surface S24 facing the first surface S23.

Here, the first surface S23 may be a surface positioned outwardly from the center of the mixing tube 201, and the second surface may be a surface positioned inwardly from the center of the mixing tube 201. The most-downstream supply ports 213 of the two inlet passages 210 in the longitudinal direction thereof may be formed on a corresponding second inner surface S24.

When the most-downstream supply ports 213 are formed on that second inner surface S24, the concentration of fuel is high on the outside of the outlet passage 230 and is relatively low in the center of the outlet passage 230. If the concentration of fuel needs to be high on the outside of the mixing tube 201 according to the operating condition of the gas turbine, this mixing tube 201 may be applied to control the concentration of fuel.

Hereinafter, a gas turbine according to a fifth exemplary embodiment will be described.

Figure 12:
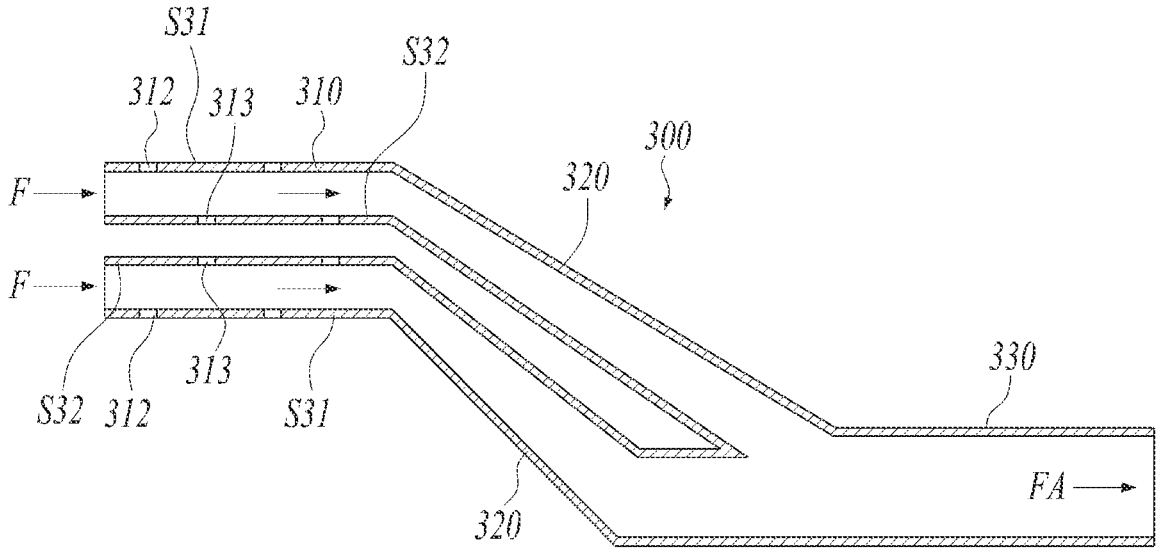
FIG. 12 is a longitudinal cross-sectional view illustrating one mixing tube according to a fifth exemplary embodiment.

FIG. 12 is a longitudinal cross-sectional view illustrating one mixing tube according to the fifth exemplary embodiment.

Referring to FIG. 12, since the gas turbine according to the present exemplary embodiment has the same structure as the gas turbine according to the third exemplary embodiment, with the sole exception of mixing tubes 300, a redundant description thereof will be omitted.

Each mixing tube 300 includes two inlet passages 310, two inclined passages 320, and one outlet passage 330. The two inlet passages 310 are spaced apart from each other. The two inclined passages 320 are connected to the inlet passages 310, respectively, and are inclined in the same direction. The two inclined passages 320 may be connected to the outlet passage 330, and the premixed fuel introduced from the inclined passages 320 may join at the outlet passage 330.

The two inclined passages 320 may be inclined at different angles with respect to the outlet passage 330. That is, the inclined passage 320 disposed inwardly from the center of the mixing tube 300 may be obliquely connected to the outlet passage 330 at an angle greater than the inclined passage 320 disposed outwardly therefrom.

The mixing tube 300 has a plurality of supply ports 312 and 313 spaced apart in the longitudinal and width directions of the mixing tube 300. The plurality of first supply ports 312 formed on the first surface S31 of the mixing tube 300 may be staggered with the plurality of second supply ports 313 formed on the second surface S32 facing the first surface S31.

As is apparent from the above description, according to the exemplary embodiments, since the supply ports are staggered with each other so that the fluid injected from the supply ports forms a vortex, fuel and air can be mixed more uniformly.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A nozzle for a combustor that burns fuel containing hydrogen, comprising:

a plurality of mixing tubes through which air and fuel flow, wherein each mixing tube of the plurality of mixing tubes comprises:

a first surface separated from a second surface;

an inlet in communication with an inlet passage having the inlet formed at one end thereof, an inclined passage connected to the inlet passage and inclined with respect to the inlet passage, and an outlet passage connected to the inclined passage;

a plurality of first supply ports formed through the first surface of the mixing tube at the inlet passage;

a plurality of second supply ports formed through the second surface of the mixing tube at the inlet passage, wherein the plurality of the first supply ports are staggered with the plurality of second supply ports; and a multi-tube configured to insert the mixing tubes there into and support the same, wherein the inclined passage is inclined with respect to the outlet passage, an angle formed by the inclined passage and the outlet passage is larger than an angle formed by to the inlet passage and the outlet passage.

2. The nozzle according to claim 1, wherein the first supply ports are staggered with the second supply ports in a width direction of the mixing tube.

3. The nozzle according to claim 1, wherein the first supply ports are staggered with the second supply ports in a longitudinal direction of the mixing tube.

4. The nozzle according to claim 1, wherein the individual first supply ports each are positioned between the corresponding second supply ports, and the second fluid is injected from the first supply ports and the second supply ports in opposite directions to form a vortex.

5. The nozzle according to claim 1, wherein the mixing tube has a rectangular cross-section in which its width is greater than its height.

6. The nozzle according to claim 1, wherein the mixing tube comprises two curved surfaces that connect the first surface and the second surface and each have an arc shape.

7. The nozzle according to claim 1, wherein the mixing tube comprises the inclined passage having an inner wall, wherein the inner wall narrows between the outlet passage and the inlet passage.

8. The nozzle according to claim 7, wherein the outlet passage has a larger cross-sectional area than the inlet passage.

9. The nozzle according to claim 8, wherein the inclined passage has a variable cross-sectional area that gradually increases from the inlet passage to the outlet passage.

10. A combustor comprising a burner having a plurality of nozzles for injecting fuel and air, and a duct assembly coupled to one side of the burner to burn a mixture of the fuel and the air therein and transmit combustion gas to a turbine, wherein each of the nozzles comprises:

a plurality of mixing tubes through which air and fuel flow, wherein each mixing tube of the plurality of mixing tubes comprises:

a first surface separated from a second surface;

an inlet at a longitudinal end and an outlet at an opposite end;

the inlet in communication with the inlet passage having an inlet formed at one end thereof, an inclined passage connected to the inlet passage and inclined with respect to the inlet passage, and an outlet passage connected to the inclined passage;

a plurality of first supply ports formed through the first surface of the mixing tube at the inlet passage;

a plurality of second supply ports formed through the second surface of the mixing tube at the inlet passage, wherein the plurality of first supply ports are staggered with the plurality of second supply ports;

a multi-tube configured to insert the mixing tubes there into and support the same, wherein the inclined passage is inclined with respect to the outlet passage, an angle formed by the inclined passage and the outlet passage is larger than an angle formed by to the inlet passage and the outlet passage.

11. The combustor according to claim 10, wherein the first supply ports are staggered with the second supply ports in a width direction of the mixing tube.

12. The combustor according to claim 10, wherein the first supply ports are staggered with the second supply ports in a longitudinal direction of the mixing tube.

13. The combustor according to claim 10, wherein the mixing tube comprises the inlet passage having the inlet formed at one end thereof and the supply ports formed on an inner wall thereof, the inclined passage connected to the inlet passage and inclined with respect to the inlet passage, and the outlet passage connected to the inclined passage to inject a mixed fluid into a combustion chamber.

14. A gas turbine comprising a compressor configured to compress air introduced there into from the outside, a combustor configured to mix fuel with the air compressed by the compressor for combustion, and a turbine having a plurality of turbine blades rotated by combustion gas produced by the combustion in the combustor, wherein the combustor comprises a burner having a plurality of nozzles for injecting the fuel and the air, and a duct assembly coupled to one side of the burner to burn a mixture of the fuel and the air therein and transmit the combustion gas to the turbine, wherein each of the nozzles comprises:

a plurality of mixing tubes through which air and fuel flow, wherein each mixing tube of the plurality of mixing tubes comprises:

a first surface separated from a second surface;

an inlet at a longitudinal end and an outlet at an opposite end;

the inlet in communication with an inlet passage having the inlet formed at one end thereof, an inclined passage connected to the inlet passage and inclined with respect to the inlet passage, and an outlet passage connected to the inclined passage;

a plurality of first supply ports formed through the first surface of the mixing tube at the inlet passage;

a plurality of second supply ports formed through the second surface of the mixing tube at the inlet passage, wherein the plurality of first supply ports are staggered with the plurality of second supply ports; and a multi-tube configured to insert the mixing tubes there into and support the same, wherein the inclined passage is inclined with respect to the outlet passage, an angle formed by the inclined passage and the outlet passage is larger than an angle formed by to the inlet passage and the outlet passage.

15. The gas turbine according to claim 14, wherein the first supply ports are staggered with the second supply ports in a width direction of the mixing tube.

* * * * *